US008317117B2

(12) United States Patent
Galloway et al.

(10) Patent No.: US 8,317,117 B2
(45) Date of Patent: Nov. 27, 2012

(54) CHIPPER DRUM WITH INTEGRAL BLOWER

(75) Inventors: Edwin N. Galloway, Pella, IA (US); James L. O'Halloran, Pella, IA (US); Jeffrey D. Bradley, Pella, IA (US); John T. Bouwers, Pella, IA (US); Larry Schut, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 12/599,619

(22) PCT Filed: May 1, 2008

(86) PCT No.: PCT/US2008/062214

§ 371 (c)(1), (2), (4) Date: Aug. 9, 2010

(87) PCT Pub. No.: WO2008/140954

PCT Pub. Date: Nov. 20, 2008

(65) Prior Publication Data

US 2010/0294868 A1 Nov. 25, 2010

Related U.S. Application Data

(60) Provisional application No. 60/928,928, filed on May 10, 2007.

(51) Int. Cl.
*B02C 23/28* (2006.01)

(52) U.S. Cl. ..... 241/55; 241/57; 241/93

(58) Field of Classification Search ..... 241/92, 241/55, 56, 57, 93
See application file for complete search history.

(56) References Cited

U.S. PATENT DOCUMENTS

| | | | |
|---|---|---|---|
| 3,162,222 | A | 12/1964 | Kirsten |
| 3,328,188 | A | 6/1967 | Heberlein |
| 6,032,707 | A | 3/2000 | Morey et al. |

FOREIGN PATENT DOCUMENTS

| | | |
|---|---|---|
| GB | 967770 | 8/1964 |

OTHER PUBLICATIONS

Terex Woodsman Drum (admitted prior art).

*Primary Examiner* — Mark Rosenbaum
(74) *Attorney, Agent, or Firm* — Merchant & Gould P.C.

(57) ABSTRACT

The chipper drum of the present disclosure is configured to maximize its cutting width while decreasing its overall size. In particular, the chipper drum of the present disclosure includes air deflectors recessed on the ends of the drum that are configured to generate the air flow necessary to blow chips out of the chipper.

24 Claims, 19 Drawing Sheets

CHIPPER DRUM WITH INTEGRAL BLOWER

This application is a National Stage Application of PCT/US2008/062214, filed May 1, 2008, in the name of Vermeer Manufacturing Company, a U.S. national corporation, applicant for the designation of all countries except the US, and Edwin N. Galloway, James L. O'Halloran, Jeffrey D. Bradley, John T. Bouwers and Larry Schut, citizens of the U.S., applicants for the designation of the US only, and claims priority to U.S. Provisional Patent Application Ser. No. 60/928, 928, filed May 10, 2007, and which applications are incorporated herein by reference. To the extent appropriate, a claim of priority is made to each of the above disclosed applications.

TECHNICAL FIELD

The present invention relates generally to a chipper and, more particularly, to a chipper having a chipper drum with an integral blower.

BACKGROUND

Chippers are used to reduce branches, trees, brush, and other bulk wood products into small chips. A chipper typically includes an infeed chute, a feed system for controlling the feed rate of wood products into the chipper, a chipping mechanism, a drive system for powering the feed system and the chipping mechanism, and a discharge chute. For a description of an infeed chute see WOOD CHIPPER INFEED CHUTE, incorporated in its entirety herein by reference.

The chipping mechanism is commonly a large cutter drum that includes blades thereon. The drum is commonly driven by an engine via a belt. For a description of a belt drive system see BELT TENSIONING APPARATUS, incorporated in its entirety herein by reference. The drum is used to grind, flail, cut, or otherwise reduce the material fed into the chipper into small chips. Besides acting as the chipping mechanism, the drum is also commonly used to generate the air flow necessary to propel the cut chips out of the chipper.

In some prior art systems, paddles are attached to the ends of the drums to generate pressure needed to blow the chips out the discharge chute. FIG. 1 depicts a known chipper drum 10 within a drum housing 12. The chipper drum 10 is cylindrical in shape and includes a number of blades 14 and chip pockets 16 spaced apart on the cylindrical surface of the drum 10, and paddles 18 attached to the end surface of the drum 10. As the chipper drum 10 rotates about axis A in a counterclockwise direction B, it draws air into the inlet end 20 of the drum housing 12. The air flow between the chipper drum 10 and the housing 12 is accelerated by the paddles 18 through the outlet 22 of the chipper housing 12. This air flow blows the chips out of the chipper 10. In many prior art systems, the chips are blow out the rear of the chipper, which is undesirable as such chips are blow towards the operators who load the chippers from the rear.

FIG. 2 shows the chipper drum 10 rolled out flat into a rectangular shape. The paddles 18 in the known system extend beyond the edges of the cylindrical surface of the drum 10. The cylindrical surface or skin of the drum defines the cutting width $W_1$ of the drum 10. The cutter drum housing width $W_3$ needs to be large enough to allow space for the width $W_2$ of the drum, which accounts for the portion of the paddles 18 that extend beyond the width $W_1$ of the skin of the cutter drum 10.

Referring to FIG. 3, a schematic top view of a chipper 24 is shown. The chipper 24 includes a feed table 26 at the rear end of the chipper 24, a discharge chute 28 at the front end of the chipper 24, and a drum housing 12 therebetween. Feed rollers (not shown) are aligned with and positioned between the feed table 26 and the chipper housing 12. For a description of feed rollers see WOOD CHIPPER FEED ROLLER, incorporated in its entirety herein by reference. The engine 30 is positioned at the left side of the chipper 24, and the drive system 32 is positioned at a right side of the chipper 24. Increasing the width $W_3$ of the chipper drum housing 12 would result in increasing the overall width $W_O$ of the chipper 24. Conversely, decreasing the width $W_3$ of the chipper drum housing 12 would enable the overall width $W_O$ of the chipper to be decreased. Since it is desirable to minimize the overall width $W_O$ of the chipper 24 and maximize the effective cutting width $W_1$ of the drum 10, it is desirable to minimize the difference between the width of the cutter drum housing $W_3$ and the width $W_1$ of the cutter drum surface.

SUMMARY

The present disclosure relates to a chipper drum that includes a blower system housed within the drum. In one embodiment, air deflectors are located within recesses at the ends of the drum. The air deflectors cooperate with the drum housing to pressurize the chipper body, thereby causing chips within the body to propel out of the body through the discharge chute.

DETAILED DESCRIPTION

Figure 4:
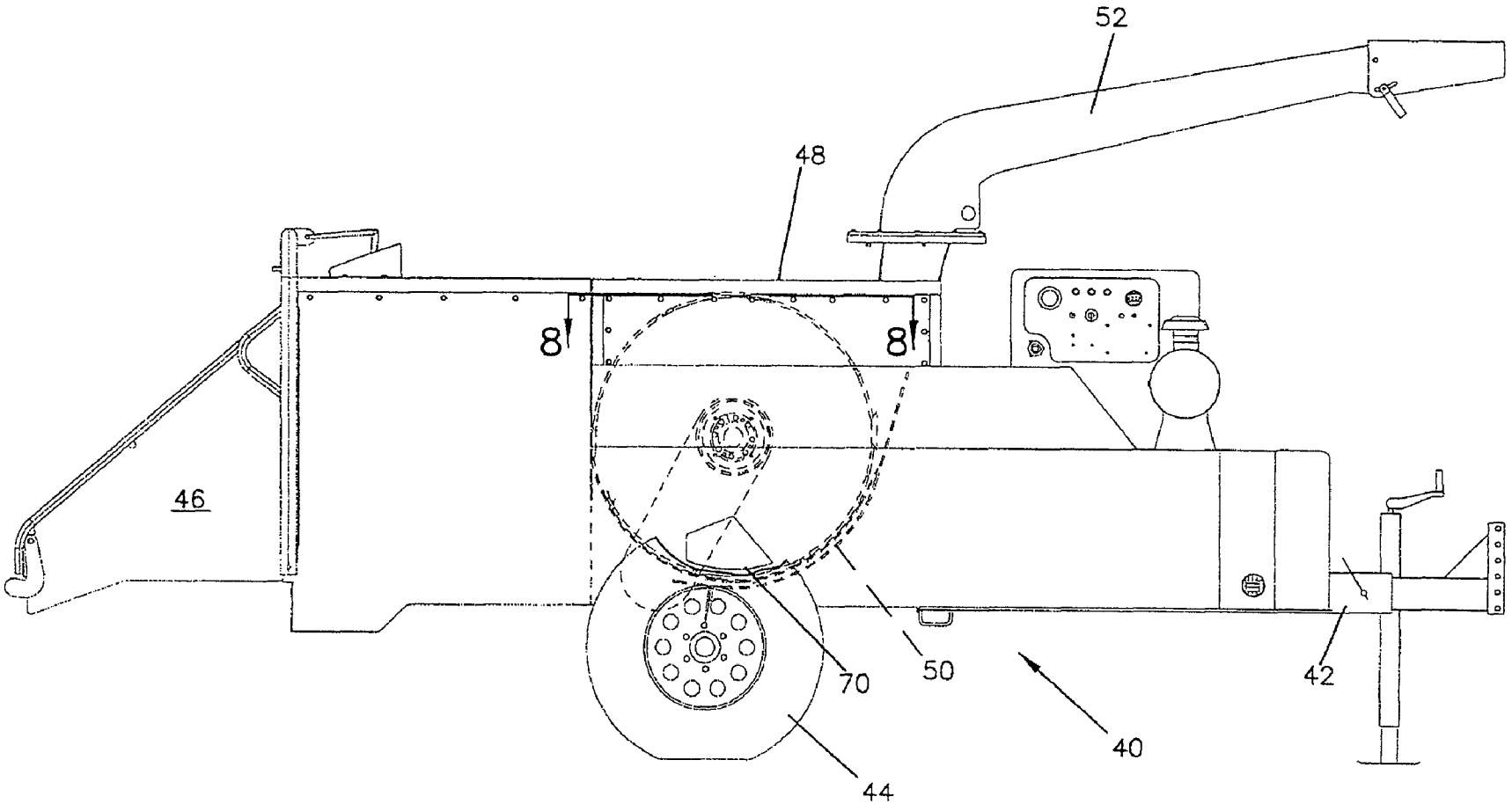
FIG. 4 is a side view of a chipper with the chipper housing and chipper drum shown in hidden lines.

Referring to FIG. 4, a chipper 40 is shown. In the depicted embodiment the chipper 40 is mounted to a frame 42 that is supported on wheels 44, which enable the chipper 40 to be conveniently moved. The depicted chipper 40 includes an infeed chute 46, which is also commonly referred to as a feed table. The infeed chute 46 can be any structure located at the rear of the chipper 40 that facilitates the loading of materials to be chipped into the chipper 40. (The material to be chipped can be any material that the user desires to reduce to chips. The material is most commonly brush and tree parts, therefore, for convenience the material to be chipped will be referred to herein as wood, trees, or brush.) As discussed in the background, a description of an infeed chute can be found in WOOD CHIPPER INFEED CHUTE. The chipper 40 in the depicted embodiment includes an infeed system that grabs and pulls brush from the infeed chute 46 into a central body portion 48 of the chipper 40, which houses cutter-drum 50 that cuts the brush into small chips. A description of an infeed system is provided in SYSTEM FOR CONTROLLING THE POSITION OF A FEED ROLLER, which is incorporated in its entirety herein by reference. Once the cutter drum 50 reduces the materials to be chipped into chips, the chips are expelled from the chipper 40 through the discharge chute 52.

Figure 5:
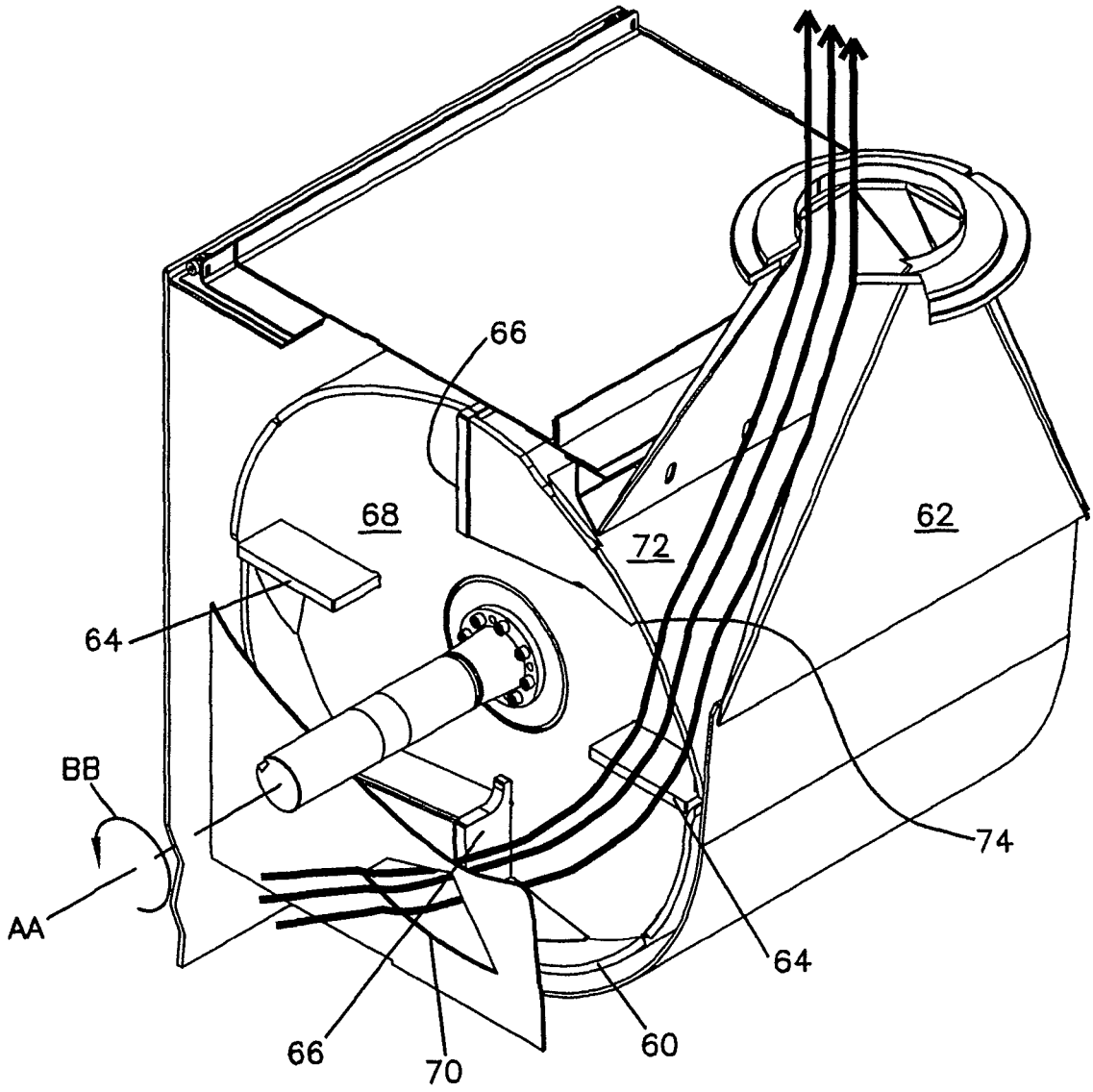
FIG. 5 is a perspective view of a first embodiment of a chipper drum and chipper drum housing according to the principles of the present disclosure.

Referring to FIG. 5, a first embodiment of a cutter drum 60 and cutter drum housing 62 of a chipper 40 according to the present disclosure is shown. The cutter drum 60 includes air deflectors (e.g., paddles) 64, 66 located within end portions 68 of the cutter drum 60. In the depicted embodiment the air deflectors extend radially along recessed end surfaces of the cutter drum 60. Though the air deflectors are shown as rectangular shaped members in FIG. 5 and scooped shaped in FIG. 13, it should be appreciated that many other air deflector configurations are also possible. Since the opposed end portions 68 of cutter drum 60 in the depicted embodiment are similar, only the right side of the drum 60 shown in FIG. 5 is described in detail herein. As the drum rotates about its axis AA in the counterclockwise direction BB, air flows from the outside of the chipper drum housing 62 through aperture 70 and is accelerated by the air deflectors 64, 66 over an edge 74 of a drum skin 72 and out the discharge chute 52.

Figure 6:
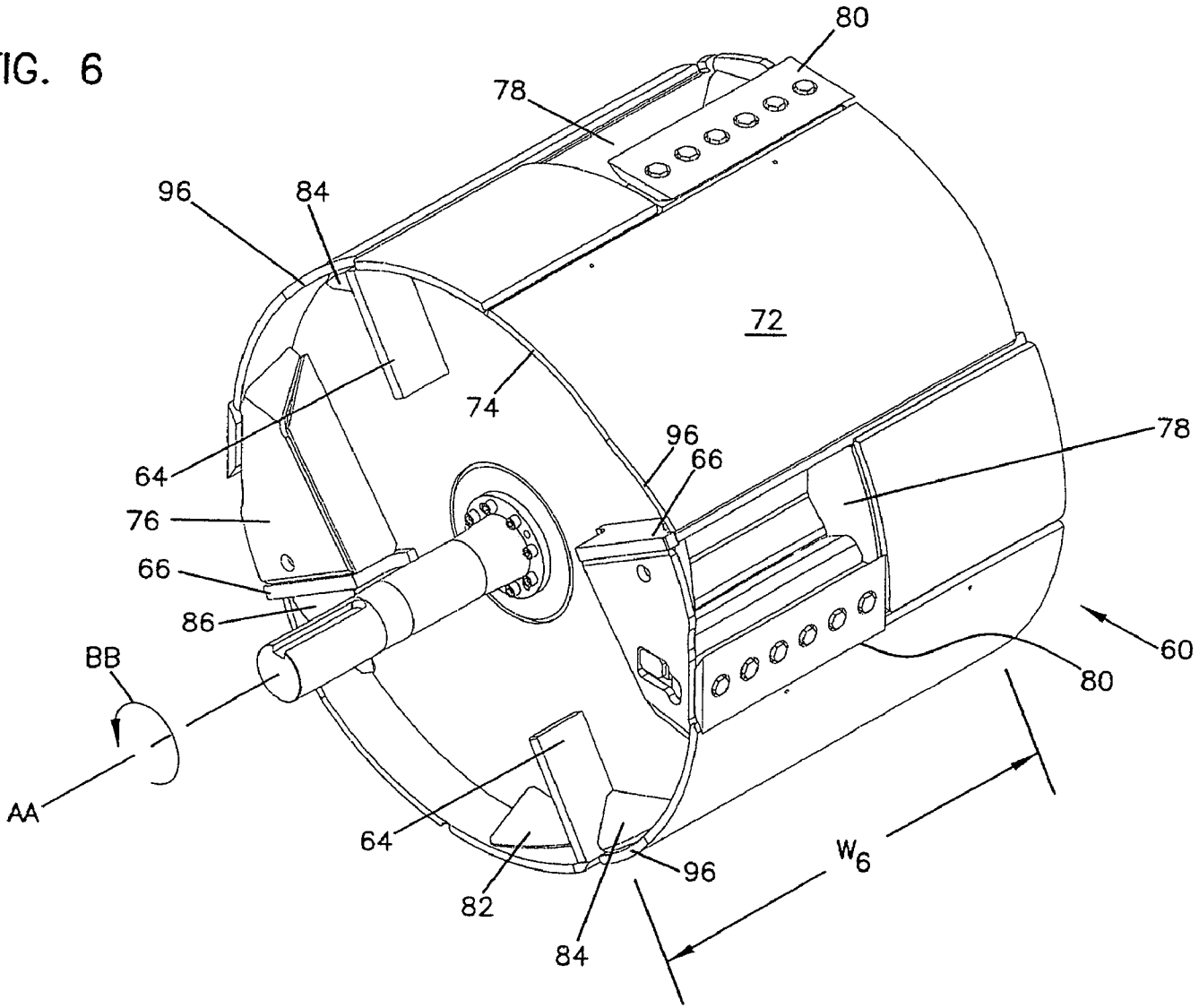
FIG. 6 is a perspective view of the chipper drum of FIG. 5.
Figure 7:
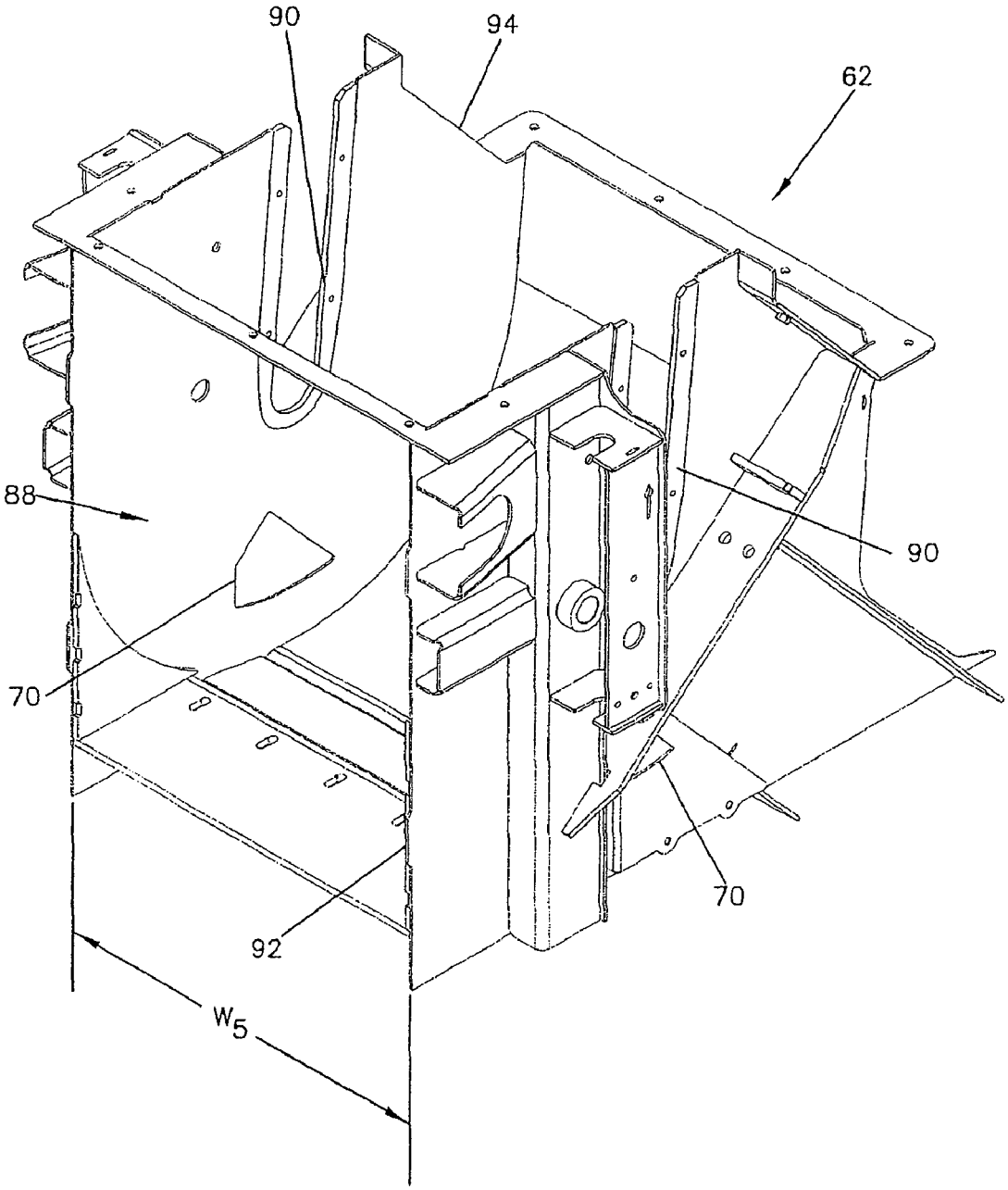
FIG. 7 is a perspective view of the chipper drum housing of FIG. 5.
Figure 8:
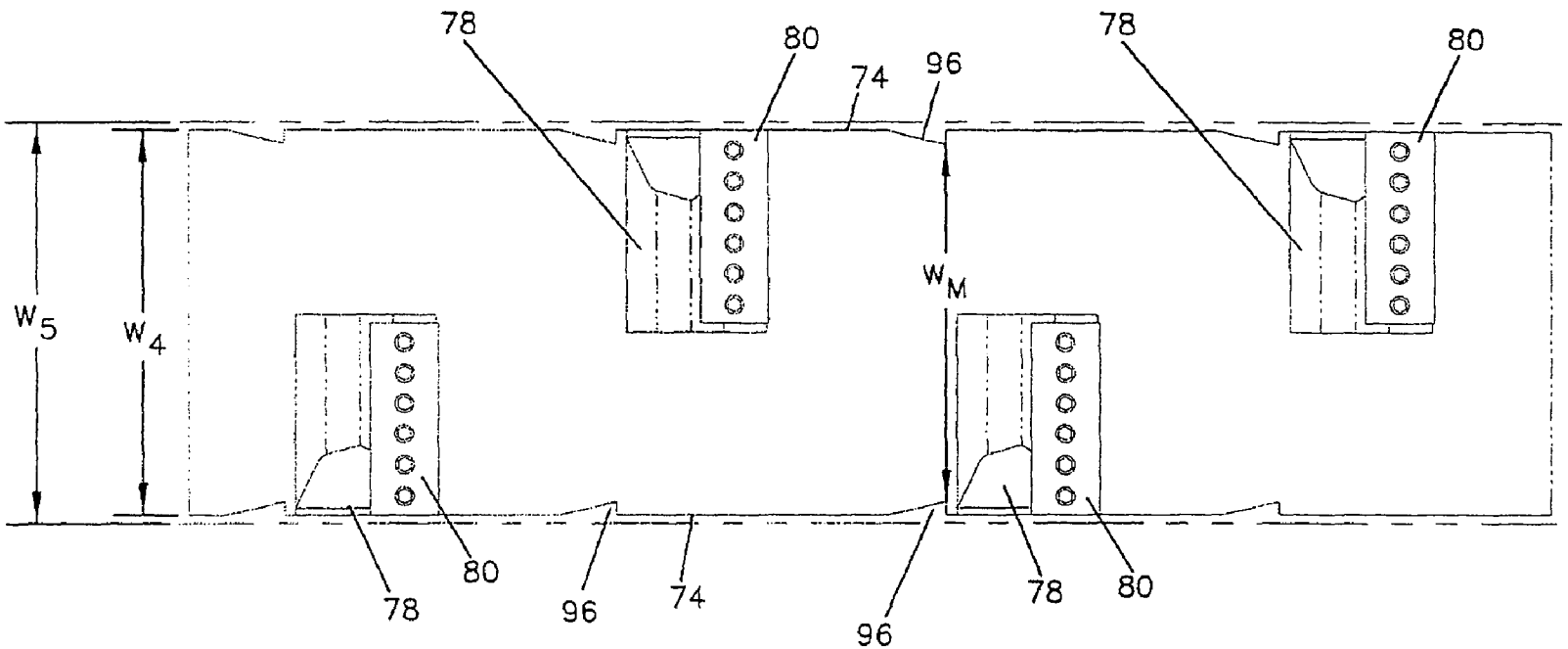
FIG. 8 is a view of a chipper drum rolled out in a flat plan view for explanatory purposes.

Referring to FIGS. 6-8, the cutter drum 60 and the cutter drum housing 62 are shown in greater detail. The cutter drum 60 includes auxiliary structural supports 76 on the end portion 68 of the cutter drum 60 adjacent the chip pockets 78. In the depicted embodiment, the chip pockets 78 are located directly in front of the blades 80. Also, auxiliary deflectors 82, 84, and 86 are located adjacent the deflectors 64, 66 to facilitate air flow and prevent debris buildup on the cutter drum 60. It should be appreciated that many other configurations are also possible.

Referring to FIGS. 7-8, the cutter drum housing 62 includes a drum chamber 88, an axis support 90, an inlet 92, and an outlet 94. The cutter drum housing 62 includes a width $W_5$ that is slightly larger than the width $W_4$ of the cutter drum 60. In the depicted embodiment the width $W_4$ of the cutter drum 60 is also the effective cutting width of the cutter drum 60. The width $W_5$ of the housing is also the maximum width of the cutter drum 60. In the depicted embodiment the width $W_5$ is less than 6 inches greater than $W_4$. Preferably, $W_5$ is less than 1.5 inches greater than $W_4$. In the depicted embodiment, $W_5$ is approximately 28¾ inches and $W_4$ is approximately 28 inches. Referring specifically to FIG. 8, the cutter drum housing 62 is shown rolled out flat with air flow channels shown as notches 96. The notches 96 allow air to flow over the edges 74 of the cutter drum 60. In the depicted embodiment the width $W_5$ of the cutter drum 60 varies. In one embodiment the width varies by more than 1 inch and the minimum width $W_M$ of the drum is located at the notches 96. Though in the depicted embodiment the notches 96 are offset from the chip pockets 78, it should be appreciated that in alternative embodiments of the drum 60 the notches 96 can be in other locations as well.

Figure 1:
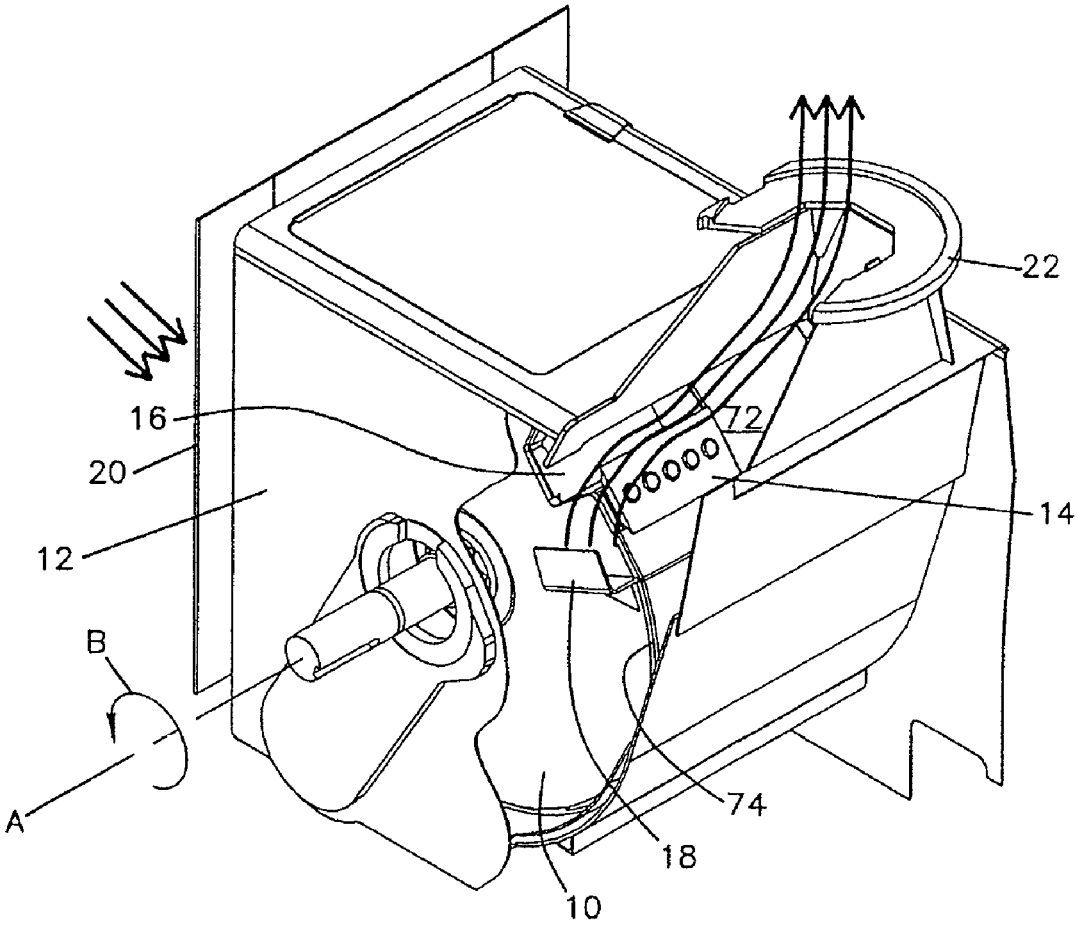
FIG. 1 PRIOR ART
FIG. 1 is a perspective view of a prior art chipper drum and chipper drum housing.
Figure 2:
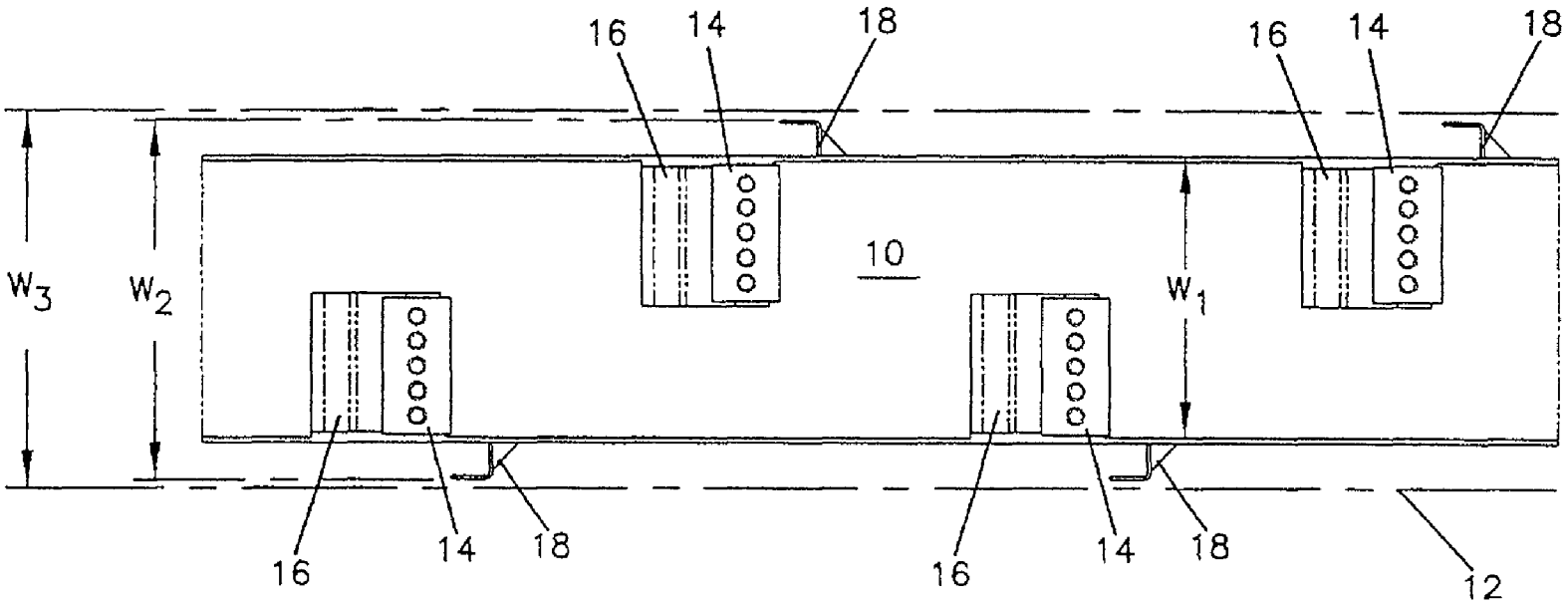
FIG. 2 PRIOR ART
FIG. 2 is a view of the chipper drum rolled out in a flat plan view for explanatory purposes.
Figure 3:
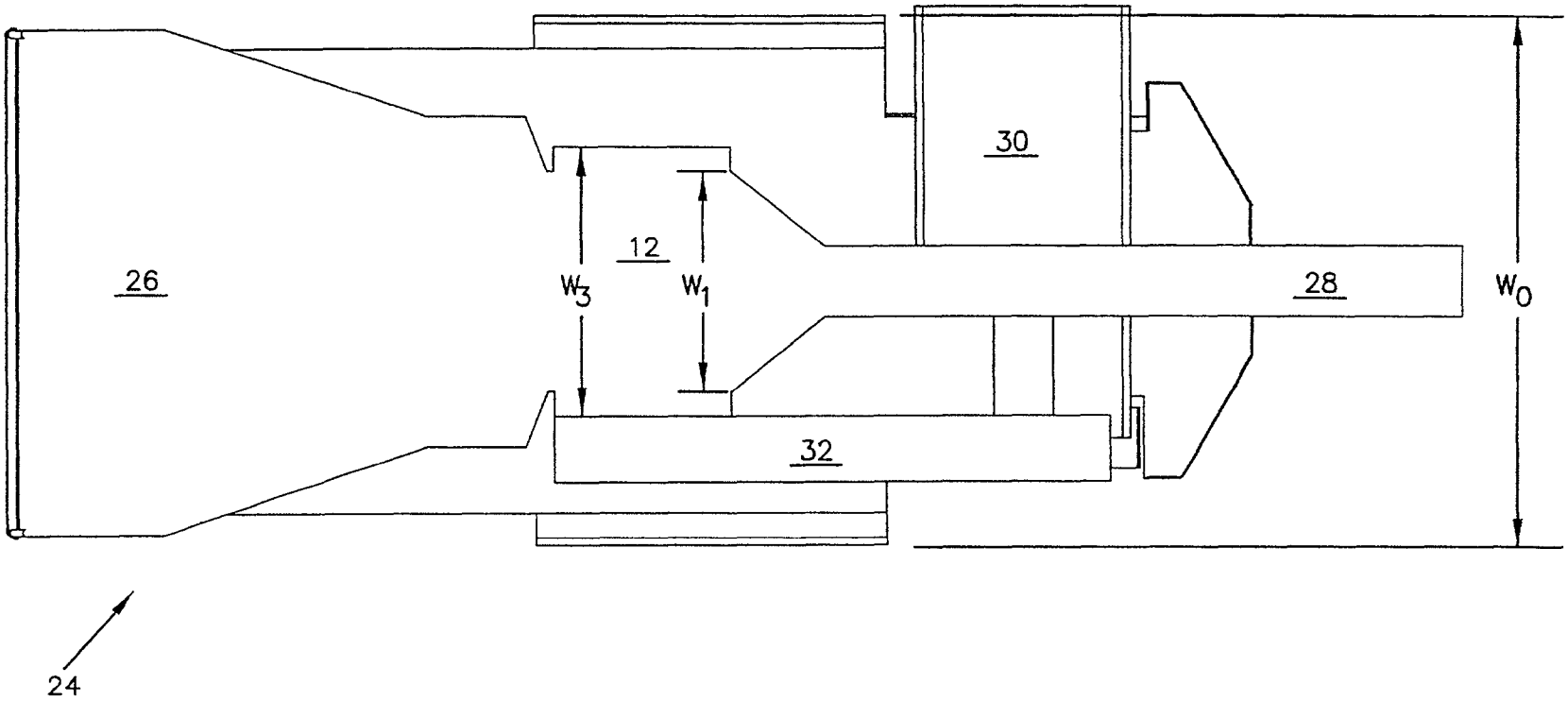
FIG. 3 PRIOR ART
FIG. 3 is a diagrammatic view of a prior art chipper layout.
Figure 9:
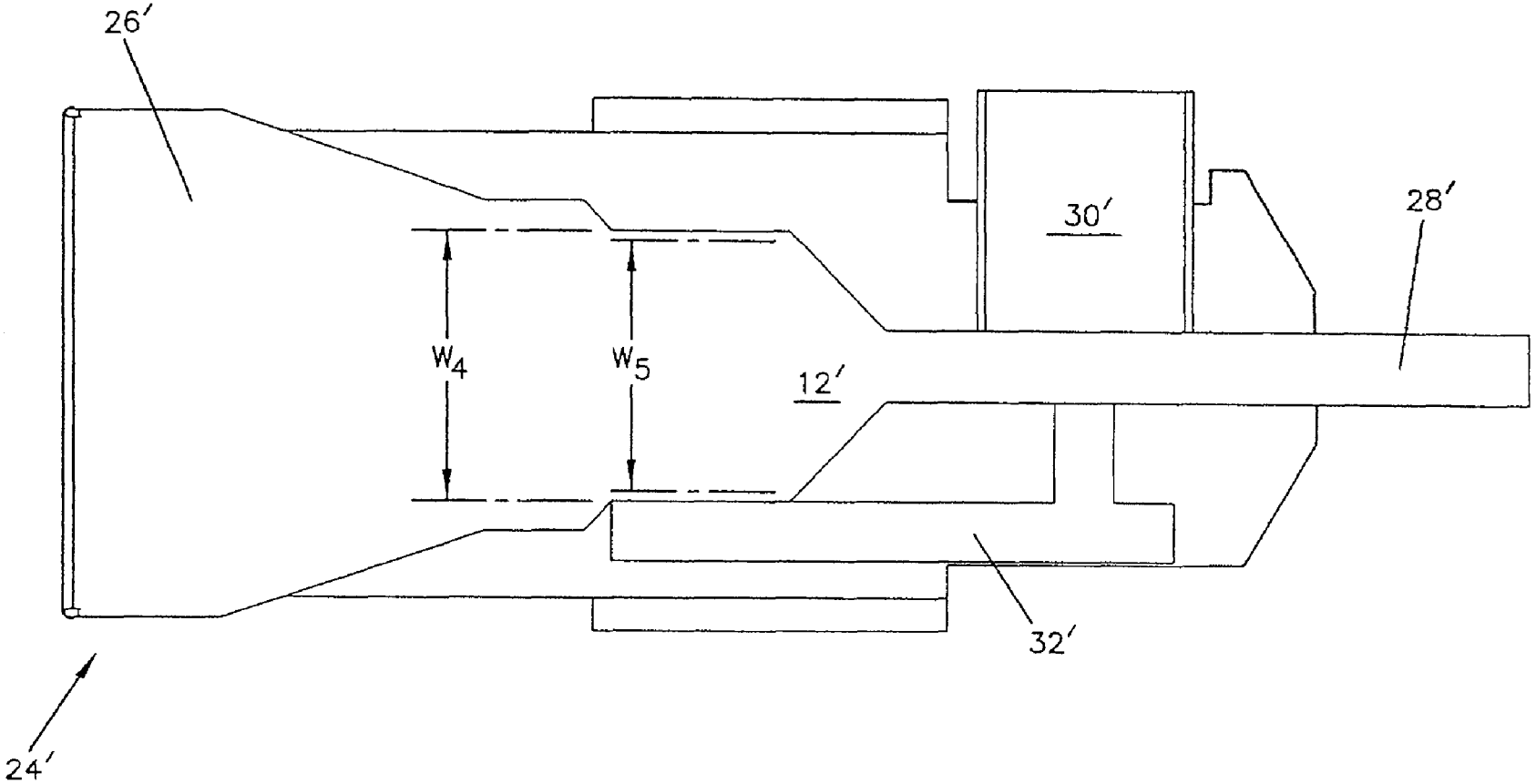
FIG. 9 is a diagrammatic view of a chipper layout incorporating the principles of the present disclosure.
Figure 10:
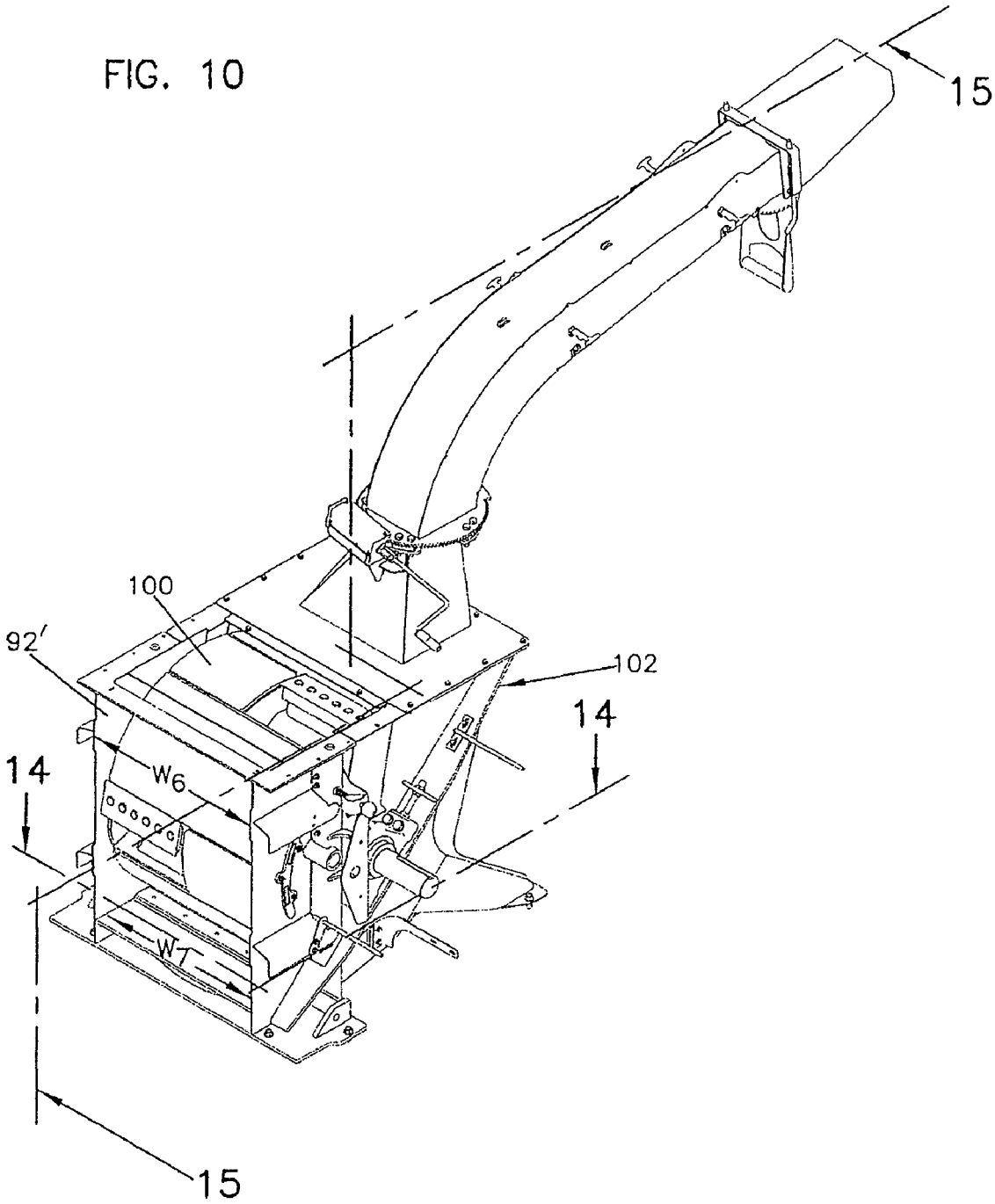
FIG. 10 is a perspective view of a second embodiment of a chipper drum and chipper drum housing according to the principles of the present disclosure.
Figure 11:
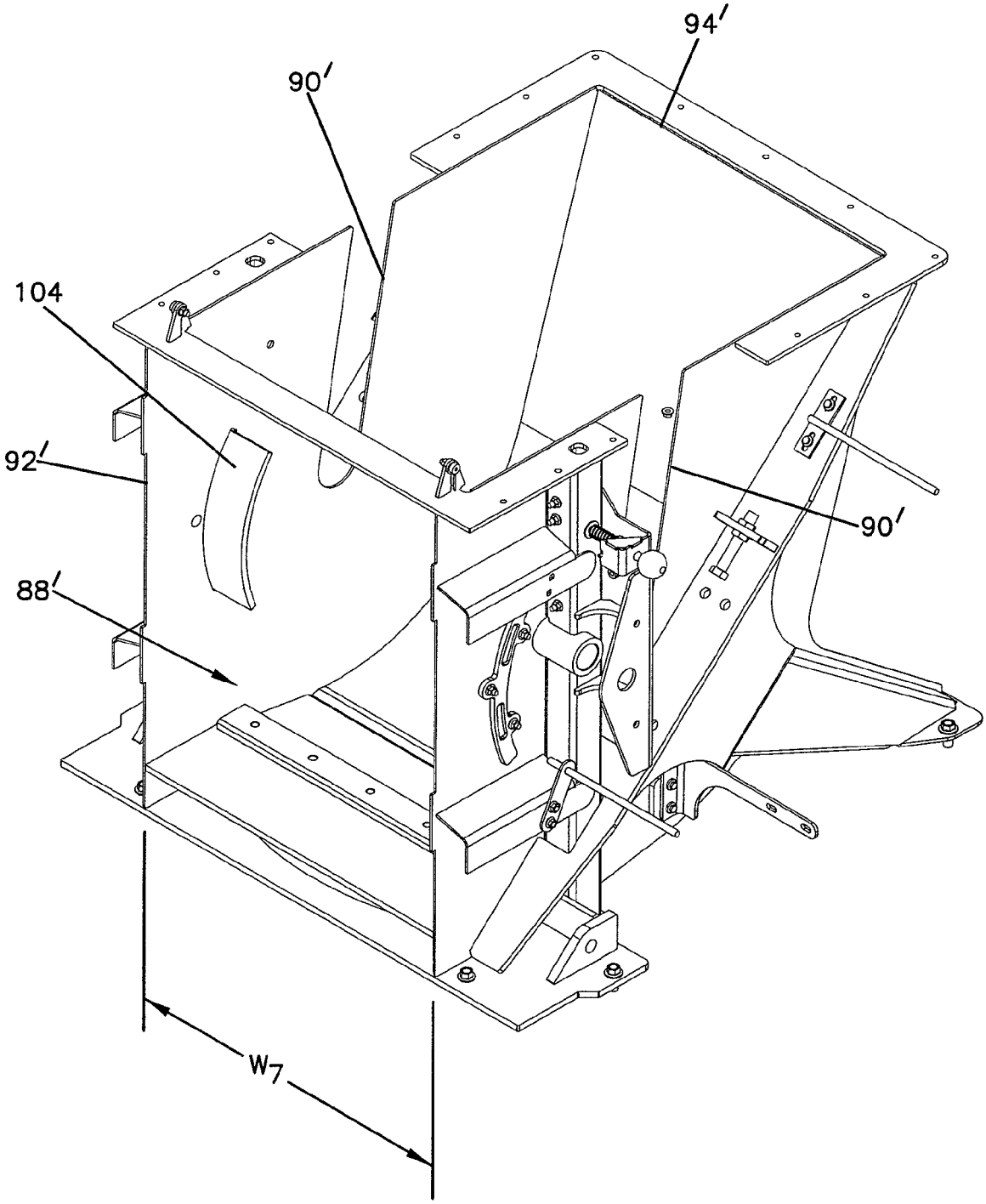
FIG. 11 is a perspective view of the chipper drum housing of FIG. 10.

Referring to FIG. 9, a chipper layout according to the principles of the present disclosure is shown. Like FIG. 3, the chipper 24' includes a feed table 26' at the rear end of the chipper 24', a discharge chute 28' at the front end of the chipper 24', and a drum housing 12' therebetween. Feed rollers (not shown) are aligned with and positioned between the feed table 26' and the chipper housing 12'. The engine 30' is positioned at the left side of the chipper 24', and the drive system 32' is positioned at right side of the chipper 24'. Since the air deflectors 64, 66 of the chipper 24' of the present disclosure are recessed relative to the edge 74 of a drum skin 72 of the cutter drum 60, the cutter drum 60 has a relatively larger cutting width than the same width cutter drums of the prior art. In the depicted embodiment the air defectors 64, 66 overlap the blades 80 of the cutter drum 60 along the width of the cutter drum 60. In the depicted embodiment, the width $W_5$ of the cutter drum housing 62 is closer to the width $W_4$ than is the width $W_3$ to width $W_1$ of FIG. 3 (prior art). The depicted embodiment increases the effective cutting width $W_4$ of the cutter drum 60 without increasing the width $W_5$ of the cutter drum housing 62. In the depicted embodiment the width $W_5$ is ¾ inches greater than the width $W_4$.

Figure 12:
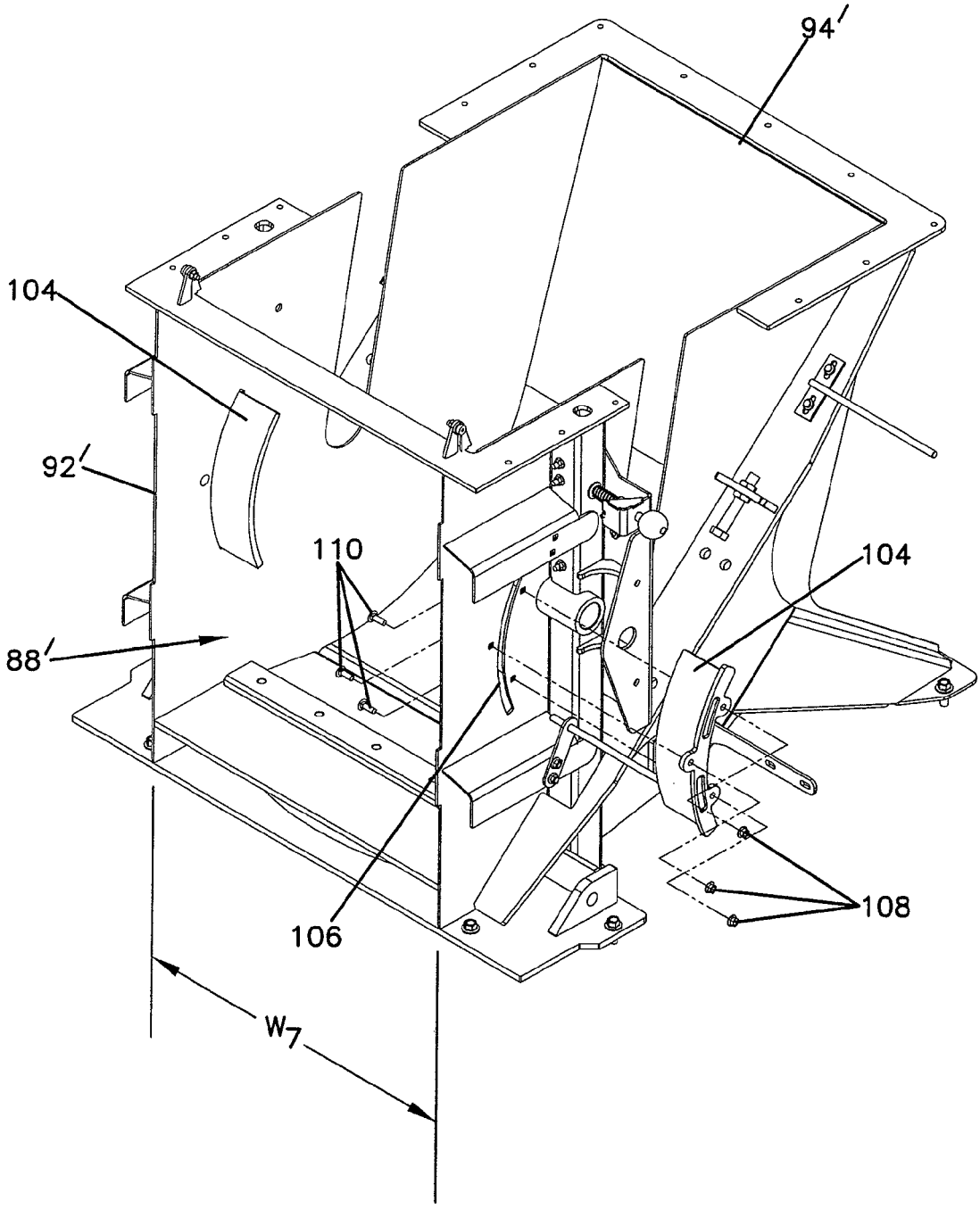
FIG. 12 is a perspective assembly view of the chipper drum housing of FIG. 10.

Referring to FIGS. 10-15, a second alternative embodiment of a chipper drum 100 and chipper drum housing 102 is shown. Like the first embodiment, the chipper drum 100 and chipper drum housing 102 of the second embodiment are configured such that the width $W_6$ of the cutting drum 100 is maximized while the width $W_7$ of the cutter drum housing 102 is minimized. The cutter drum housing 102 includes a drum chamber 88', an axis support 90', an inlet 92', and an outlet 94'. The cutter drum housing 102 includes a width $W_7$ that is slightly larger than the width $W_6$ of the cutter drum 100. The cutter drum housing 102 also includes a housing deflector 104 for preventing air and chips from being projected out of the inlet 92' of the cutter drum housing 102. Referring particularly to FIG. 12, the housing deflector 104 is shown in an assembly view as being mounted to the cutter drum housing 102 through a slot 106 via nuts 108 and bolts 110.

Figure 13:
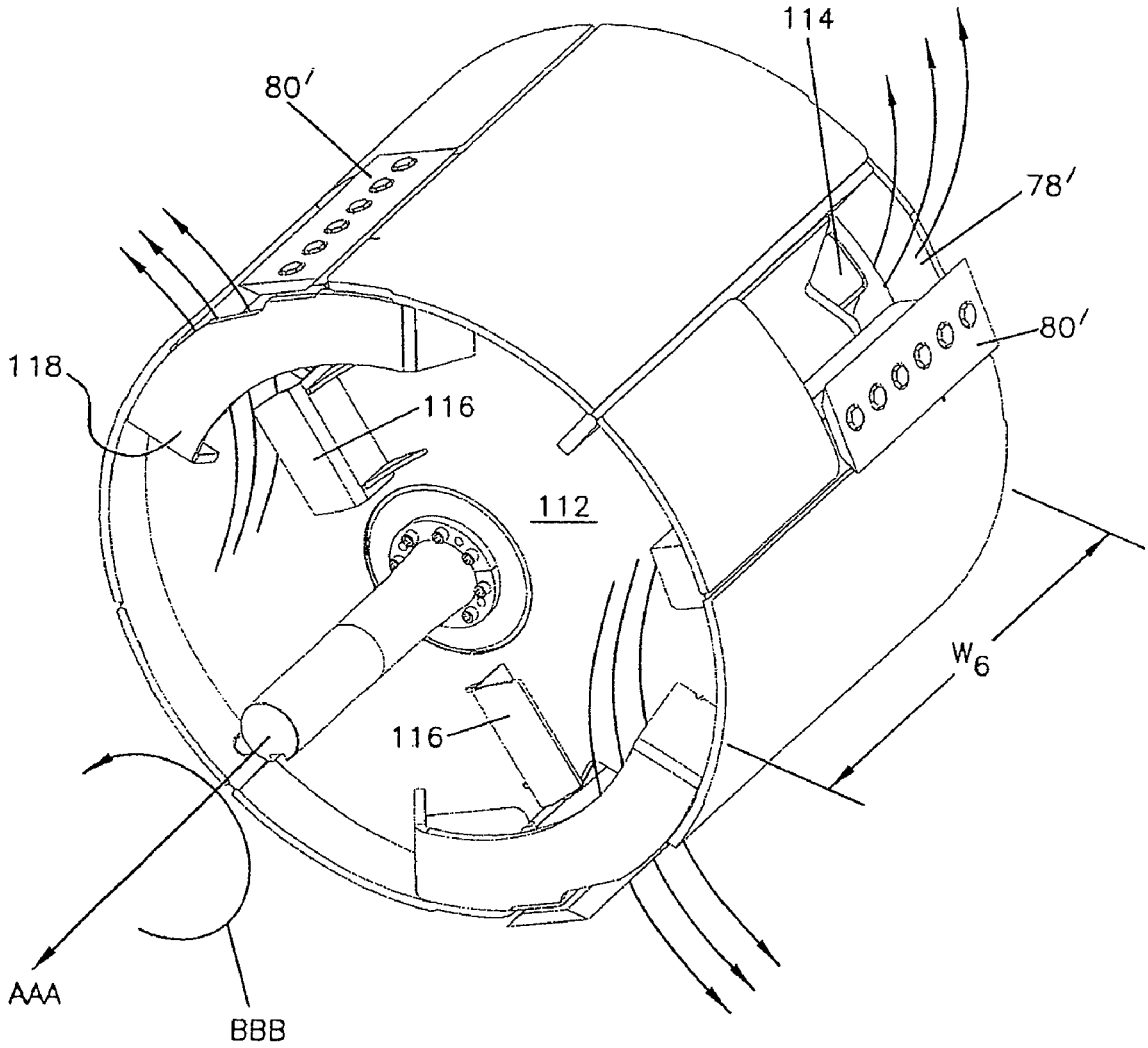
FIG. 13 is a perspective view of the chipper drum of FIG. 10.
Figure 14:
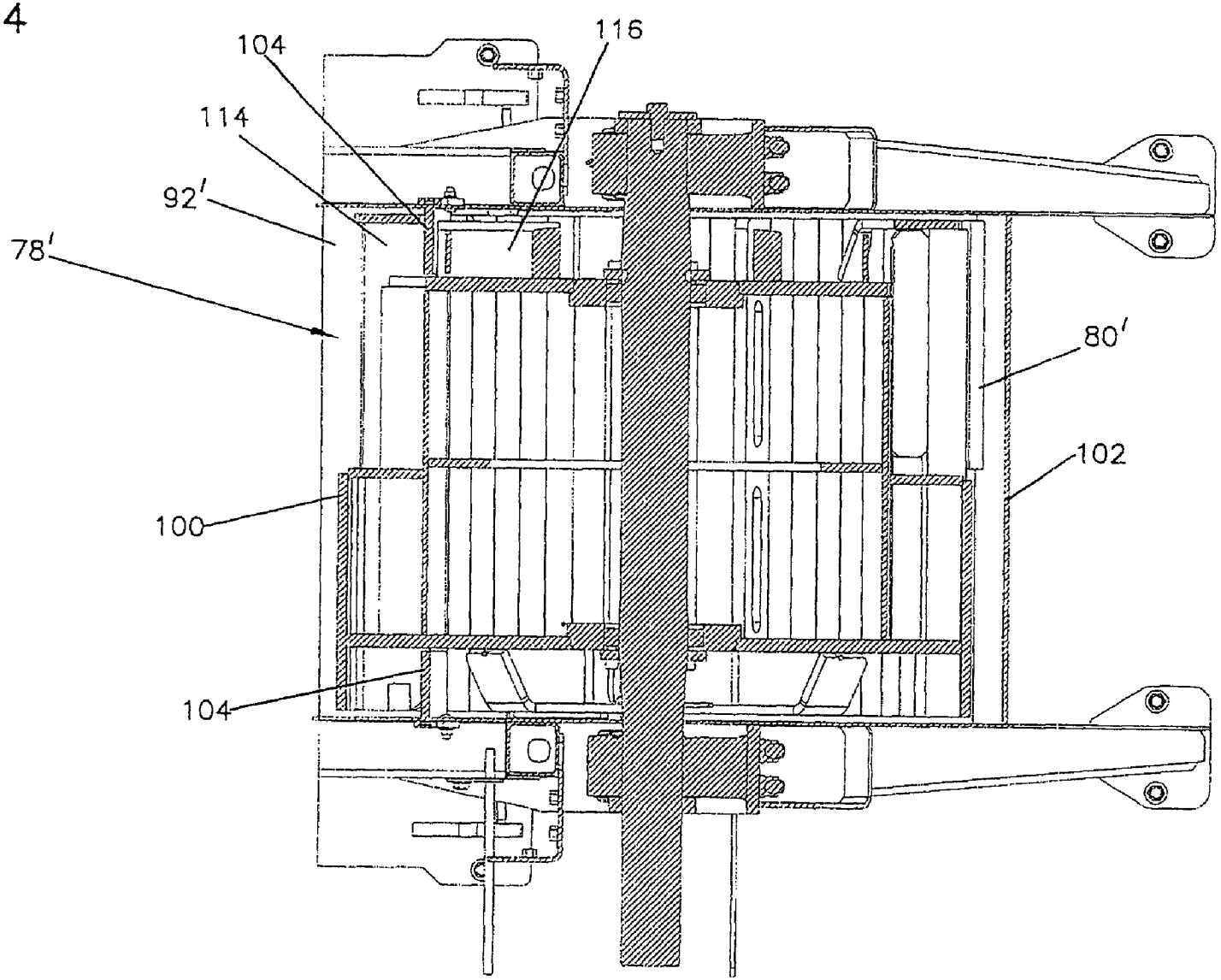
FIG. 14 is a cross-sectional view of the chipper drum and chipper drum housing generally along line 14-14 of FIG. 10.
Figure 15:
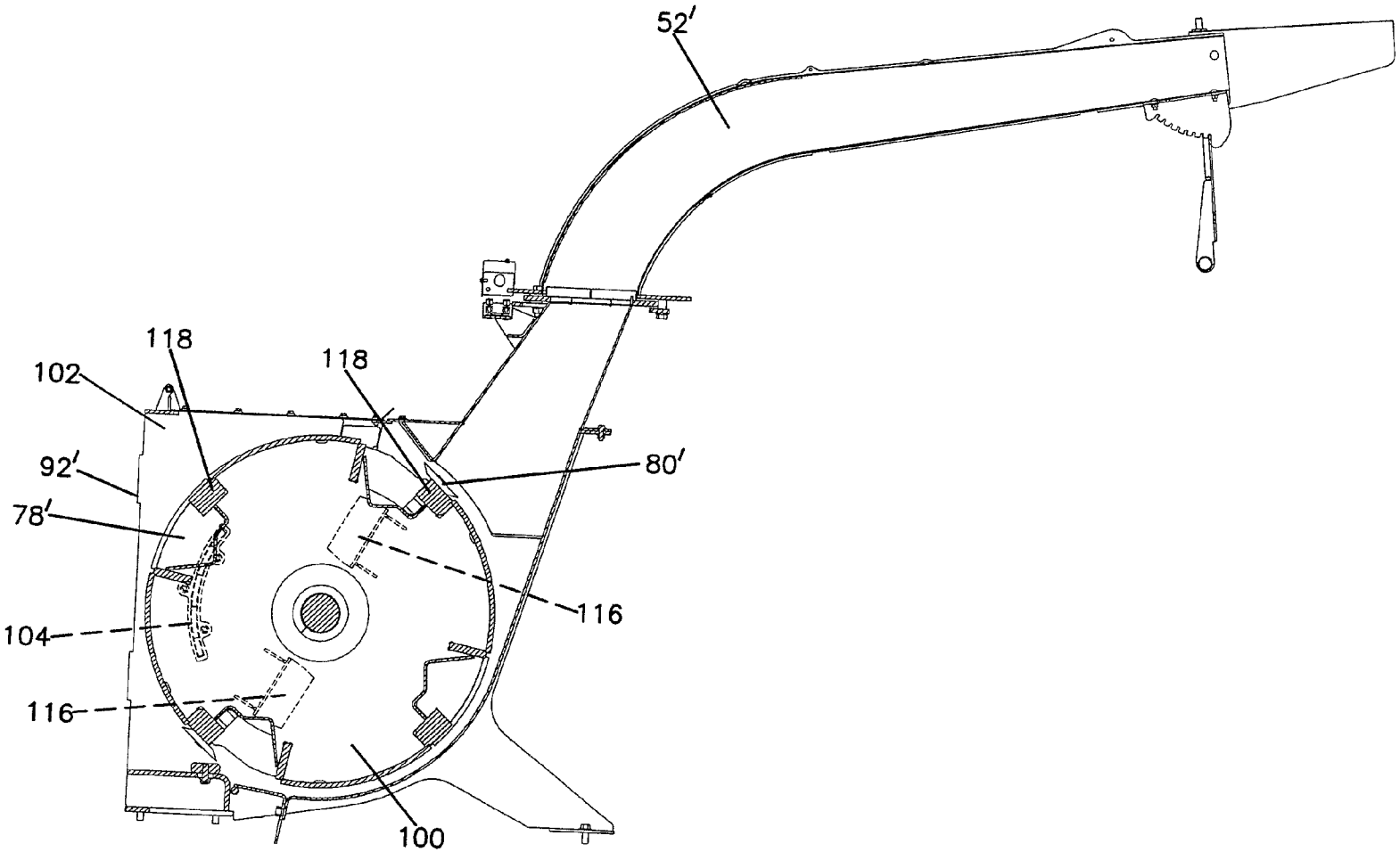
FIG. 15 is a cross-sectional view of the chipper drum and chipper drum housing generally along line 15-15 of FIG. 10.

Referring to FIG. 13, the cutter drum 100 of the second embodiment does not include notches to facilitate air flow. Instead, the drum is constructed to direct air from the ends 112 of the cutter drum through a window 114 in the chip pocket 78'. In the depicted embodiment the ends are generally perpendicular to the rotational axis AAA of the drum and recessed relative to the cutting surface of the drum 100. Like the cutter drum 60 of the first embodiment, the cutter drum 100 of the second embodiment includes blades 80' adjacent the chip pockets 78'. As the drum rotates about the axis AAA in the counterclockwise direction BBB, air from outside of the chipper drum housing 102 is accelerated by the paddles 116 and auxiliary deflectors 118 through the window 114. In the depicted embodiment the two paddles 116 are scoop shaped with an L-shaped side profile. In the depicted embodiment the L-shaped paddles 116 are directional, that is, the paddles 116 perform differently when the drum is rotated in the clockwise direction than when the drum is rotated in the counterclockwise direction. This air flow projects the chips out of the chipper. The housing deflector 104 on the housing 102 prevents air/chips from flowing through the window 114 when the pocket 78' faces the inlet 92' of the chipper drum housing 102, as it is desirable to blow the chips through the outlet 94' rather than the inlet 92'. FIG. 14 is a cross-sectional view of the cutter drum 100 and cutter drum housing 102 of FIG. 10 generally along line 14-14. FIG. 15 is a cross-sectional view of the cutter drum 100 and cutter drum housing 102 of FIG. 10 generally along line 15-15. FIGS. 14 and 15 illustrate how the housing deflector 104 blocks the window 114 when the chip pocket 78' faces the inlet 92' of the cutter drum housing 102 to facilitate chips being ejected out of the discharge chute 52' rather than the inlet 92'.

Figure 16:
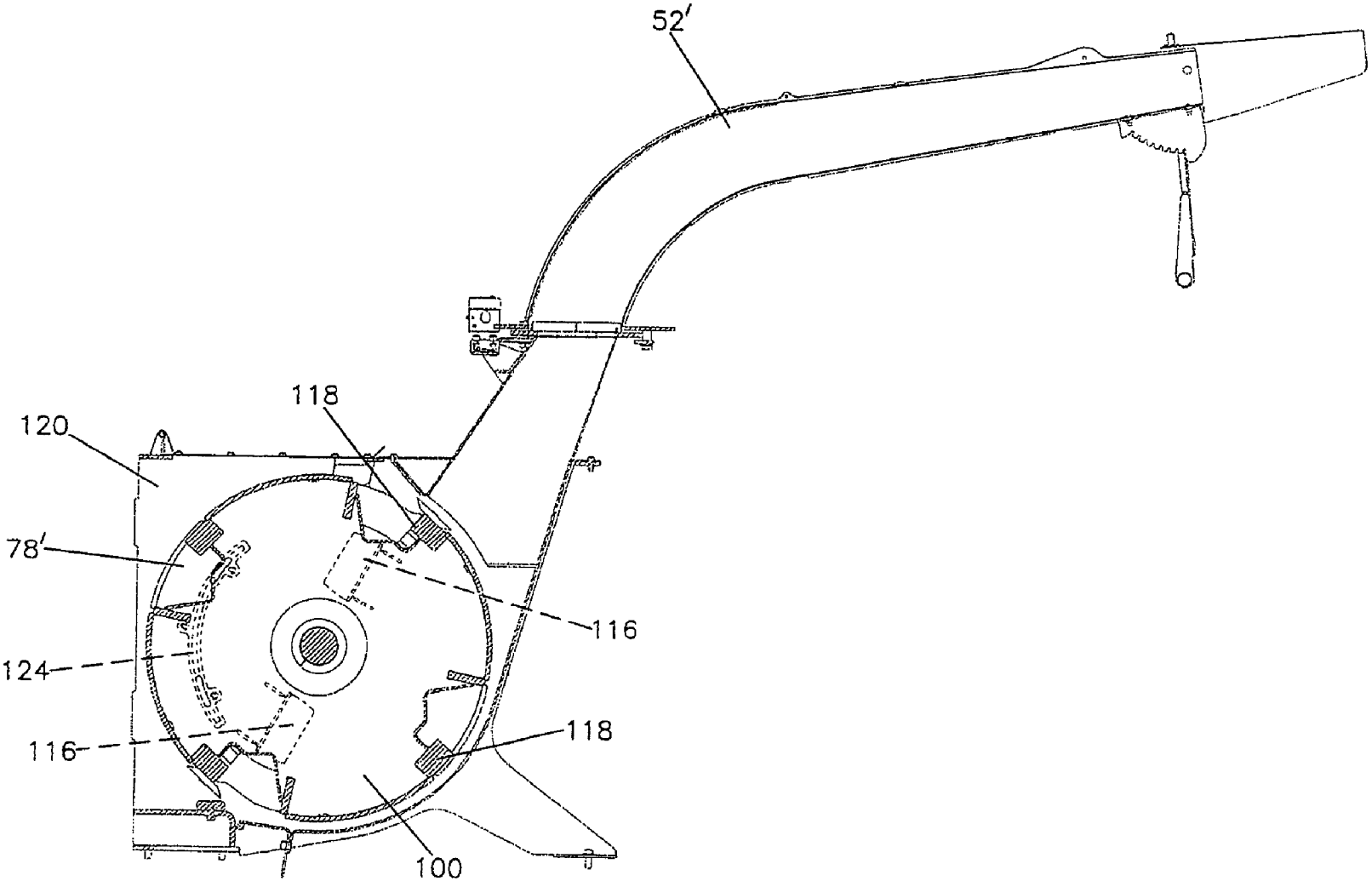
FIG. 16 is a cross-sectional view of a third embodiment of a chipper drum and chipper drum housing.
Figure 17:
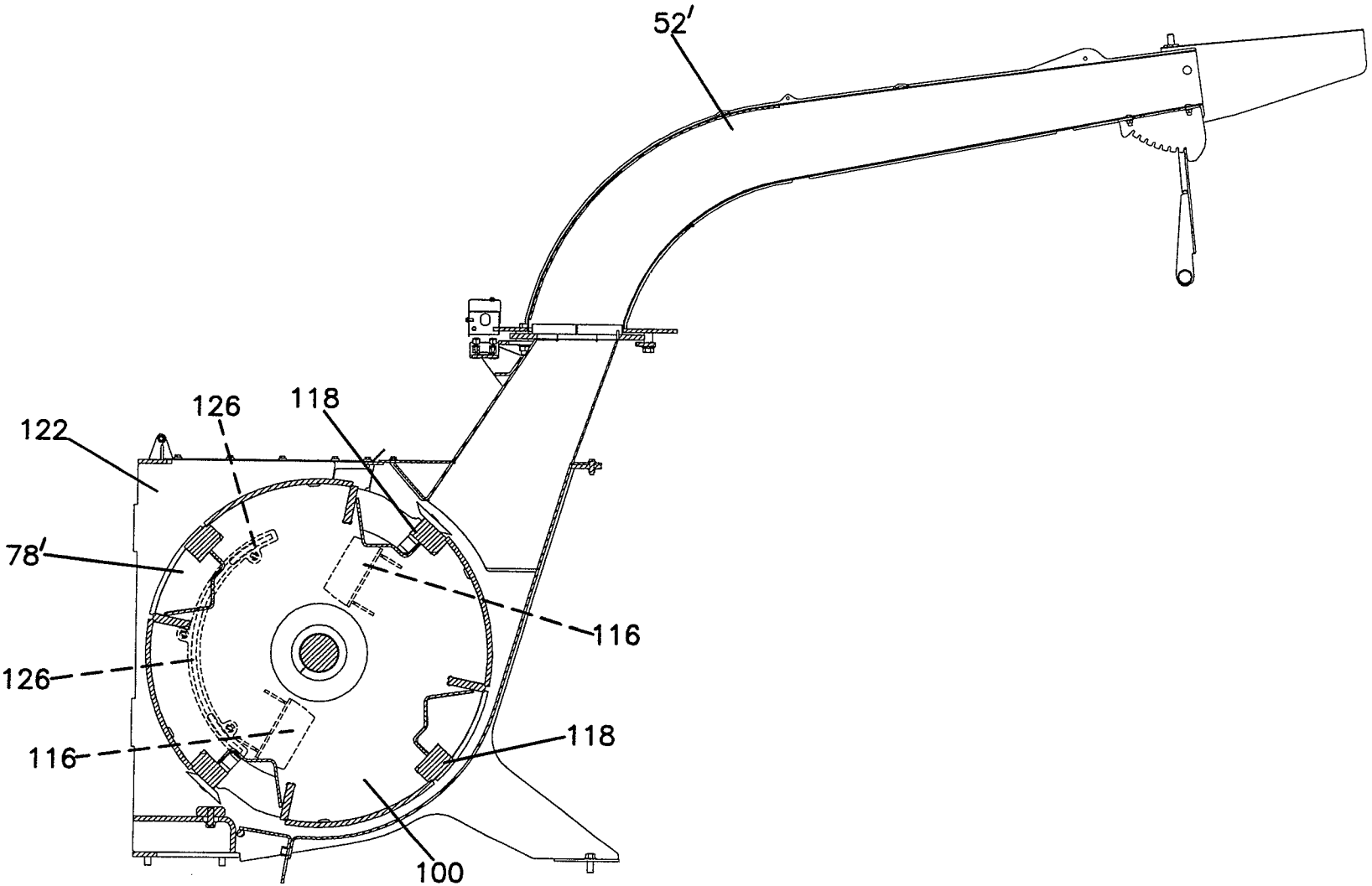
FIG. 17 is a cross-sectional view of a fourth embodiment of a chipper drum and chipper drum housing.

FIGS. 16 and 17 show the cutter drum 100 being housed within cutter drum housings 120, 122, which are similar to the cutter drum housing 102 of the second embodiment. The difference between the cutter drum housings 120, 122 relates to the size of the housing deflectors 124, 126.

Figure 18:
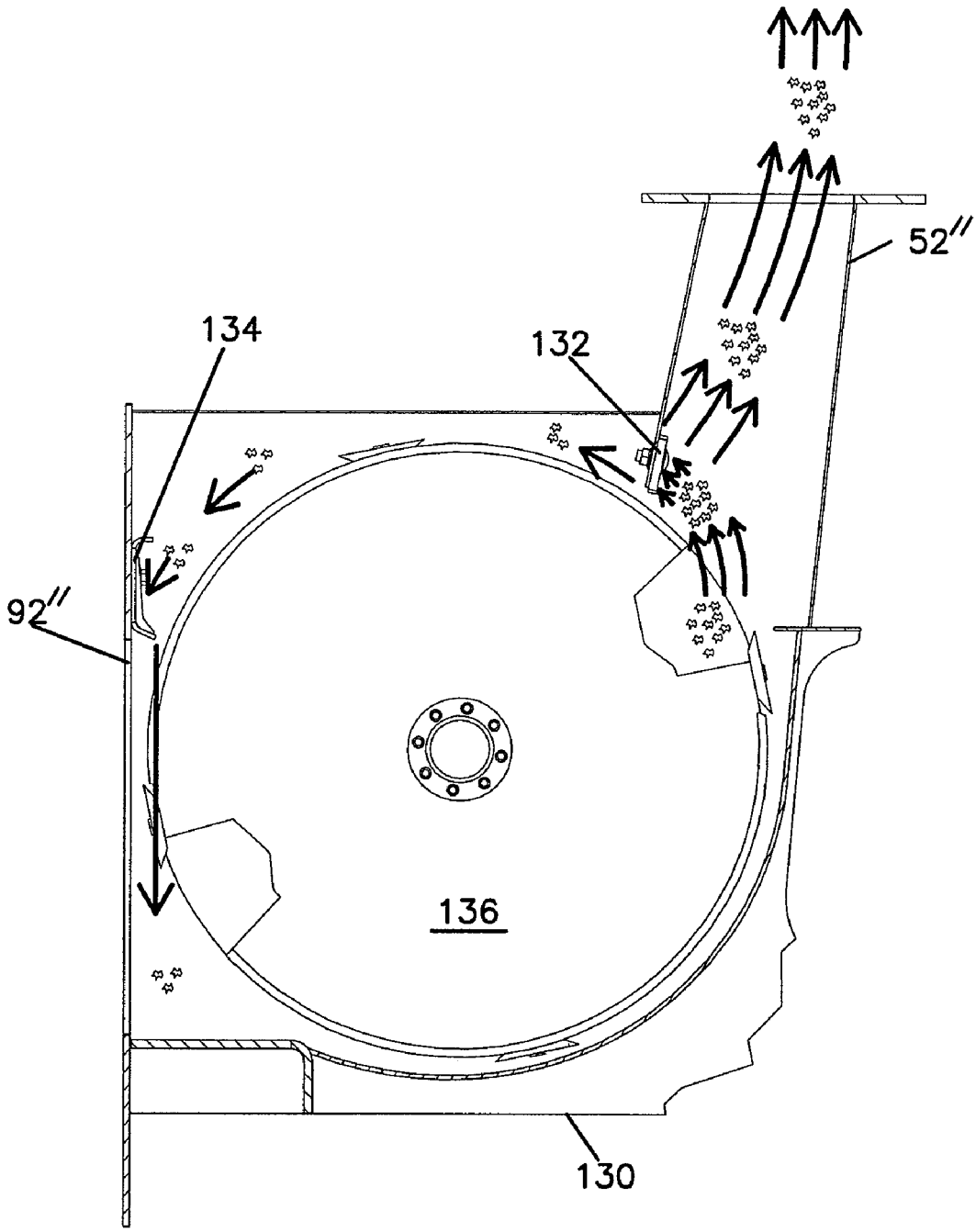
FIG. 18 is a diagrammatic view of chips moving through a chipper drum housing according to the principles of the present disclosure.
Figure 19:
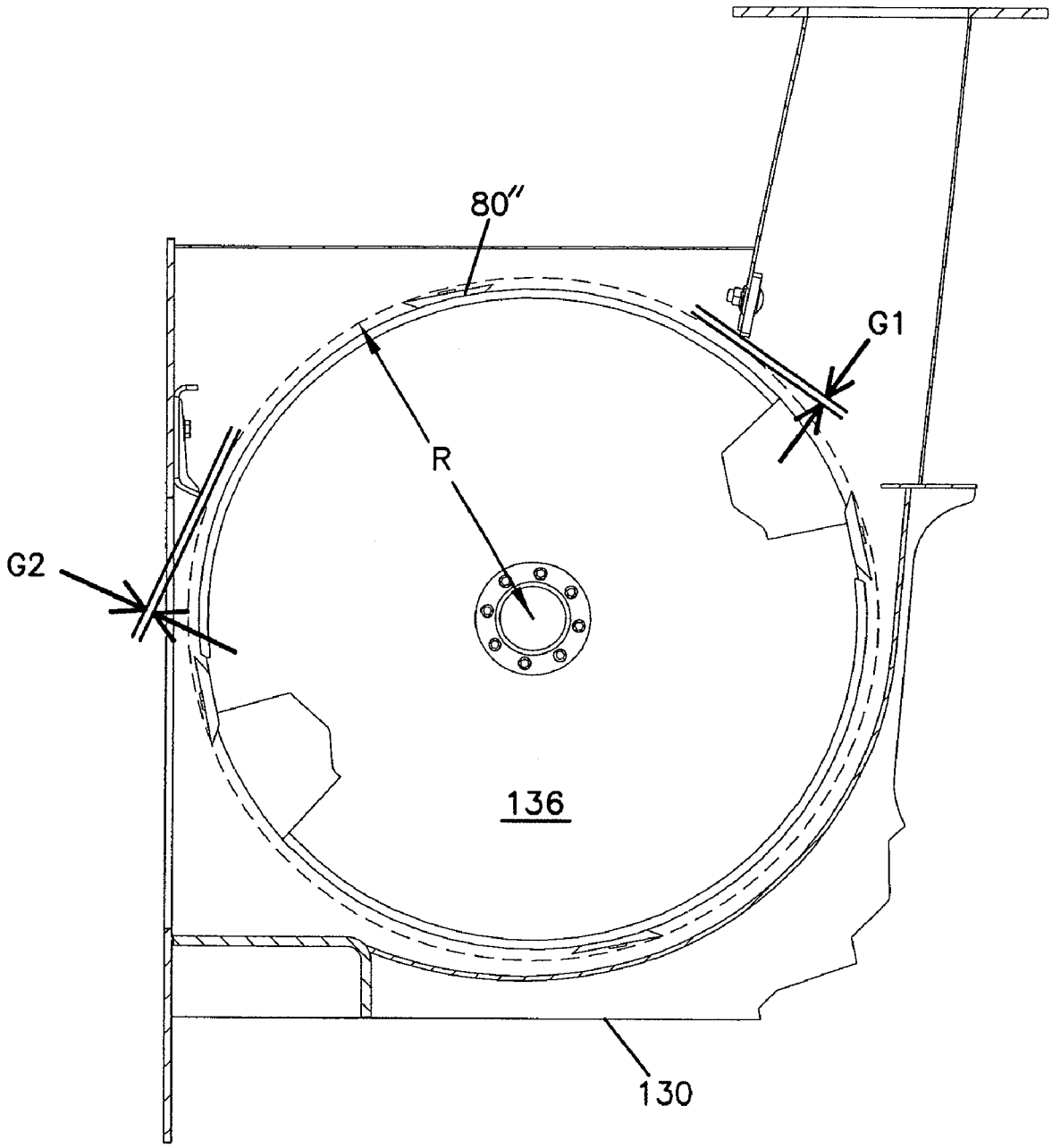
FIG. 19 is a view of FIG. 18 with dimensions.

Referring to FIGS. 18 and 19, the cutter drum housing 130 includes an upper 132 and a lower 134 housing chip deflector. In the depicted embodiment, the chip defectors 132 and 134 extend substantially across the width of the drum 136. The upper and lower housing chip deflectors 132 and 134 are positioned to direct chips from the cutter drum housing 130 to the discharge chute 52" and to further prevent chips from discharging through the inlet 92". The upper housing chip deflector 132 primarily functions to deflect chip towards the discharge chute 52", whereas the lower housing chip deflector 134 primarily functions to prevent chips from being ejected out of the inlet 92" of the housing 130. In the depicted embodiments the upper and lower housing chip deflectors 132 and 134 are adjustable. In the depicted embodiment the radius R of the cutter drum 136 measured from the axis of rotation of the cutter drum 136 to the edge of the blade 80" is between 6-25 inches. More preferably, the radius R is between 10-18 inches. In the depicted embodiment, the gap G1 between the near edge of the upper housing chip deflector 132 and the far edge of the blade 80" in the radial direction is between 0.0315-0.25 inches. More preferably, the gap G1 is between 0.0625-0.1875 inches. In the depicted embodiment, the gap G2 between the near edge of the lower housing chip deflector 134 and the far edge of the blade 80" in the radial direction is between 0.0315-0.25 inches. More preferably, the gap G2 is between 0.0625-0.1875 inches. Since these deflectors are adjustable, the gaps G1 and G2 can be more easily made relatively smaller than if the chip deflectors were welded to the drum.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A chipper comprising:

a feed chute, a discharge chute, and a cutter drum positioned between the feed chute and discharge chute, wherein the cutter drum rotates about an axis of rotation defined by a drive shaft of the cutter drum and includes a generally cylindrical cutting surface, opposed end surfaces recessed relative to edges of the cutting surface, a plurality of chip pockets recessed in the cylindrical cutting surface and positioned to overhang past the recessed end surfaces, and a plurality of air flow deflectors connected to the end surfaces; and wherein the chip pockets include:

open outer sides that face radially outwardly from the axis of rotation of the cutter drum;

bottom walls positioned opposite from the open outer side of the chip pockets, the chipper being configured such that the air flow from the air flow deflectors does not pass through the bottom walls; and side walls arranged such that the chip pockets are substantially closed except for the outer sides.

2. The chipper of claim 1, wherein the air deflectors extending from the end surfaces of the cutter drum do not extend beyond the edges of the cutting surface of the cutter drum.

3. The chipper of claim 1, wherein the cutter drum is cylindrical and includes end edges, wherein the end edges are uneven.

4. The chipper of claim 3, wherein the distance between the end edges of the cutter drum define a width of the cutter drum, and wherein the width varies by more than 1 inch.

5. The chipper drum of claim 4, wherein a minimum width of the cutter drum is adjacent a chip pocket.

6. The chipper drum of claim 4, wherein a minimum width of the cutter drum is offset from a chip pocket.

7. The chipper of claim 1, wherein the cutter drum includes a window that enables air to flow from the air flow deflectors to an outside cylindrical surface of the cutter drum.

8. The chipper of claim 7, further comprising a cutter drum housing, wherein the cutter drum housing includes a curved deflector plate that extends into a recessed end portion of the cutter drum.

9. The chipper of claim 1, wherein the cutter drum includes a plurality of spaced apart cutting blades fixed to the outer surface of the drum, wherein the distance between the outer edges of cutting blades on either end of the drum defines the cutting width of the cutter drum.

10. The chipper of claim 9, further comprising a cutter drum housing, the cutter drum housing including a width that is less than 1 inch greater than the cutting width of the drum.

11. The chipper of claim 1, wherein the air flow deflectors extend radially from a center portion of the end of the cutter drum to a periphery portion of the end of the drum.

12. The chipper of claim 11, wherein the air flow deflectors consist of four paddles that are evenly spaced apart on the end of the cutter drum.

13. The chipper of claim 11, wherein the paddles are rearward of air flow channels on the cutter drum.

14. The chipper of claim 11, wherein the air flow channels are notches along the edges of the cutter drum.

15. The chipper of claim 1, further comprising a chipper drum housing, the housing includes an intake vent on a surface of the housing adjacent the end of the chipper drum.

16. A chipper drum comprising:

a body having an axis of rotation defined by a drive shaft of the chipping drum, wherein the body includes a generally cylindrical side surface and opposed recessed end portions;

a plurality of blades extending from the cylindrical side surface;

a plurality of chip pockets recessed in the cylindrical side surface and positioned to overhang past the recessed end portions adjacent the blades;

a plurality of air deflectors extending radially from the recessed end portions configured to generate air flow when the chipper drum is rotated, the chipper drum being configured such that air flows from the recessed end portions to laterally across the chip pockets recessed on the cylindrical side surface and then towards the center plane of the chipper drum; and wherein the chip pockets include:

open outer sides that face radially outwardly from the axis of rotation of the cutter drum;

bottom walls positioned opposite from the open outer side of the chip pockets, the drum being configured such that the air flow from the air flow deflectors does not pass through the bottom walls; and side walls arranged such that the chip pockets are substantially closed except for the outer sides.

17. The chipper drum of claim 16, wherein blades and chip pockets are arranged in two rows on the cylindrical side surface, wherein the chip pockets and blades arranged in the two rows are offset from each other.

18. A chipper drum and housing assembly comprising:

a body, wherein the body includes a generally cylindrical side surface and opposed recessed end portions;

a plurality of blades extending from the cylindrical side surface:

a plurality of chip pockets recessed in the cylindrical side surface adjacent the blades; and a plurality of air deflectors extending radially from the recessed end portions configured to deflect air from the recessed end portions to the chip pockets on the cylindrical side surface;

a chipper drum housing including:

a drum chamber including an inlet, an outlet, and opposed side walls, wherein the side walls include air vents to enable air flow from outside of the chipper drum housing to the recessed end portions of the chipper drum; and an upper and a lower chip deflector, wherein the upper and lower chip deflectors are adjustably mounted to the chipper drum housing.

19. A chipper drum and housing assembly comprising:

a body, wherein the body includes a generally cylindrical side surface and opposed recessed end portions;

a plurality of blades extending from the cylindrical side surface;

a plurality of chip pockets recessed in the cylindrical side surface adjacent the blades; and a plurality of air deflectors extending radially from the recessed end portions configured to deflect air from the recessed end portions to the chip pockets on the cylindrical side surface;

a chipper drum housing including:

a drum chamber including an inlet, an outlet, and opposed side walls, wherein the side walls include air vents to enable air flow from outside of the chipper drum housing to the recessed end portions of the chipper drum;

an upper and a lower chip deflector, wherein the upper and lower chip deflectors are adjustably mounted to the chipper drum housing;

wherein the upper chip deflector is positioned to deflect chips from the chipper drum housing through the outlet and into a discharge chute, and wherein the lower chip deflector is positioned to deflect chips from exiting the inlet.

20. The chipper drum and housing assembly comprising:

a body, wherein the body includes a generally cylindrical side surface and opposed end portions;

a plurality of blades extending from the cylindrical side surface;

a plurality of chip pockets recessed in the cylindrical side surface adjacent the blades; and a plurality of air deflectors extending radially from the end portions configured to deflect air from the end portions to the chip pockets on the cylindrical side surface;

a chipper drum housing including:

an upper and a lower chip deflector, wherein the upper and lower chip deflectors are adjustably mounted to the chipper drum housing, wherein the upper chip deflector is positioned to direct chips from inside the housing out of the housing, and wherein the lower chip deflector is positioned to keep chips within the housing.

21. A chipper comprising:

a chipping drum that rotates about an axis of rotation defined by a drive shaft of the chipping drum, the chipping drum including a generally cylindrical outer skin that surrounds the axis of rotation, the generally cylindrical outer skin having a length that extends along the axis of rotation from a first lateral edge to a second lateral edge, the chipping drum defining a first set of circumferentially spaced-apart chipping pockets and a second set of circumferentially spaced-apart chipping pockets, the chipping pockets being recessed relative to the generally cylindrical outer skin and having open outer sides that face radially outwardly from the axis of rotation, the first set of circumferentially spaced-apart chipping pockets being adjacent to the first lateral edge of the generally cylindrical outer skin and the second set of circumferentially spaced-apart chipping pockets being adjacent to the second lateral edge of the generally cylindrical outer skin, the chipping drum also including a plurality of chipping blades that correspond to the chipping pockets;

the chipping drum including first and second lateral end plates that enclose first and second lateral ends of the chipping drum, the first and second lateral end plates being spaced-part from one another along the axis of rotation of the chipping drum, the first lateral end plate being recessed laterally inwardly with respect to the first lateral edge of the generally cylindrical outer skin such that the first lateral end plate and the generally cylindrical outer skin cooperate to define a first lateral cavity at the first end of the drum, the second lateral end plate being recessed laterally inwardly with respect to the second lateral edge of the generally cylindrical outer skin such that the second lateral end plate and the generally cylindrical outer skin cooperate to define a second lateral cavity at the second end of the drum;

the chipping drum including a plurality of air flow paddles mounted within the first and second lateral cavities, the air flow paddles being configured for generating air flow used to carry chips generated by the chipping blades to a chip outlet of the chipper;

the chipping pockets of the first set of chipping pockets extending laterally outwardly beyond the first lateral end wall of the chipping drum so as to overlap the first lateral cavity of the chipping drum, and the chipping pockets of the second set of chipping pockets extending laterally outwardly beyond the second lateral end wall of the chipping drum so as to overlap the second lateral cavity of the chipping drum;

the chipping pockets of the first set of chipping pockets having first lateral pocket end walls positioned adjacent the first lateral edge of the generally cylindrical outer skin for at least partially enclosing first lateral pocket ends of the chipping pockets of the first set of chipping pockets, the chipping pockets of the first set of chipping pockets having first bottom walls positioned opposite from the open outer sides of the first set of chipping pockets, the first bottom walls extending laterally outwardly past the first lateral end plate, the chipper being configured such that the air flow from the air flow paddles does not pass through the first bottom walls; and the chipping pockets of the second set of chipping pockets having second lateral pocket end walls positioned adjacent the second lateral edge of the generally cylindrical outer skin for at least partially enclosing second lateral pocket ends of the chipping pockets of the second set of chipping pockets, the chipping pockets of the second set of chipping pockets having second bottom walls positioned opposite from the open outer sides of the second set of chipping pockets, the second bottom walls extending laterally outwardly past the second lateral end plate, the chipper being configured such that the air flow from the air flow paddles does not pass through the second bottom walls.

22. The chipper of claim 21, wherein the first and second lateral pocket end walls have inner portions that are canted.

23. The chipper of claim 21, wherein the first and second lateral edges defined by the generally cylindrical outer skin define air flow notches that are positioned circumferentially between the chipping pockets, the air flow notches being configured to allow the air flow from the air flow paddles to flow from the first and second lateral cavities of the drum, through the notches and laterally across the generally cylindrical outer skin to the chip outlet.

24. A chipper comprising:

a chipping drum that rotates about an axis of rotation defined by a drive shaft of the chipping drum, the chipping drum including a generally cylindrical outer skin that surrounds the axis of rotation, the generally cylindrical outer skin having a length that extends along the axis of rotation from a first lateral edge to a second lateral edge, the chipping drum defining a first set of circumferentially spaced-apart chipping pockets and a second set of circumferentially spaced-apart chipping pockets, the chipping pockets being recessed relative to the generally cylindrical outer skin and having open outer sides that face radially outwardly from the axis of rotation, the first set of circumferentially spaced-apart chipping pockets being adjacent to the first lateral edge of the generally cylindrical outer skin and the second set of circumferentially spaced-apart chipping pockets being adjacent to the second lateral edge of the generally cylindrical outer skin, the chipping drum also including a plurality of chipping blades that correspond to the chipping pockets;

the chipping drum including first and second lateral end plates that enclose first and second lateral ends of the chipping drum, the first and second lateral end plates being spaced-part from one another along the axis of rotation of the chipping drum, the first lateral end plate being recessed laterally inwardly with respect to the first lateral edge of the generally cylindrical outer skin such that the first lateral end plate and the generally cylindrical outer skin cooperate to define a first lateral cavity at the first end of the drum, the second lateral end plate being recessed laterally inwardly with respect to the second lateral edge of the generally cylindrical outer skin such that the second lateral end plate and the generally cylindrical outer skin cooperate to define a second lateral cavity at the second end of the drum;

the chipping drum including a plurality of air flow paddles mounted within the first and second lateral cavities, the air flow paddles being configured for generating air flow used to carry chips generated by the chipping blades to a chip outlet of the chipper;

the chipping pockets of the first set of chipping pockets having first overhanging portions that extend laterally outwardly beyond the first lateral end wall of the chipping drum so as to overlap the first lateral cavity of the chipping drum, and the chipping pockets of the second set of chipping pockets having second overhanging portions that extend laterally outwardly beyond the second lateral end wall of the chipping drum so as to overlap the second lateral cavity of the chipping drum;

the chipping pockets of the first set of chipping pockets having first lateral pocket end walls positioned adjacent the first lateral edge of the generally cylindrical outer skin for at least partially enclosing first lateral pocket ends of the chipping pockets of the first set of chipping pockets;

the chipping pockets of the second set of chipping pockets having second lateral pocket end walls positioned adjacent the second lateral edge of the generally cylindrical outer skin for at least partially enclosing second lateral pocket ends of the chipping pockets of the second set of chipping pockets;

the chipping pockets of the first set of chipping pockets having first bottoms positioned opposite from the open outer sides of the chipping pockets of the first set of chipping pockets, the first bottoms including enclosed portions and open portions, the open portions of the first bottoms coinciding with the first overhanging portions of the first set of chipping pockets; and the chipping pockets of the second set of chipping pockets having second bottoms positioned opposite from the open outer sides of the second set of chipping pockets, the second bottoms including enclosed portions and open portions, the open portions of the second bottoms coinciding with the second overhanging portions of the second set of chipping pockets.

* * * * *